US007560865B2

(12) United States Patent
Katou et al.

(10) Patent No.: US 7,560,865 B2
(45) Date of Patent: Jul. 14, 2009

(54) DISCHARGE LAMP OF THE SHORT ARC TYPE

(75) Inventors: Masaki Katou, Himeji (JP); Motohiro Sakai, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/732,254

(22) Filed: Dec. 11, 2003

(65) Prior Publication Data

US 2004/0119412 A1 Jun. 24, 2004

(30) Foreign Application Priority Data

Dec. 18, 2002 (JP) ..... 2002-367338

(51) Int. Cl.
*H01J 61/36* (2006.01)
*H01J 1/62* (2006.01)

(52) U.S. Cl. ..... 313/625; 313/234; 313/623; 313/602

(58) Field of Classification Search ..... 313/594, 313/601, 602, 607, 234, 623–625
See application file for complete search history.

(56) References Cited

U.S. PATENT DOCUMENTS 3,851,202 A * 11/1974 Troue ..... 313/636
5,723,944 A * 3/1998 Higashi et al. ..... 313/570
6,373,189 B1 4/2002 Yasuda et al.
6,573,658 B1 6/2003 Sakai et al.
6,787,996 B1 * 9/2004 Saito et al. ..... 313/625
6,863,586 B2 * 3/2005 Okuyama ..... 445/26

FOREIGN PATENT DOCUMENTS

EP 1043754 A1 * 10/2000
JP 02-199766 8/1990
JP 02-210750 8/1990
JP 02199766 A * 8/1990

* cited by examiner

*Primary Examiner*—Mariceli Santiago
*Assistant Examiner*—Anthony T Perry
(74) *Attorney, Agent, or Firm*—David S. Safran; Roberts Mlotkowski Safran & Cole, P.C.

(57) ABSTRACT

A discharge lamp of the short arc type having an arc tube, a hermetically sealed tube at each of opposite ends of the, a pair of electrodes which are located in the arc tube, electrode rods which support the electrodes, support parts which are each formed by part of one of the hermetically sealed tubes, optionally cylindrical retaining bodies which are each located within and welded to a respective one of the support parts and in which a respective one of the electrode rods time is held securely, and a trigger component which is located on an outer side surface of the support parts, the support parts of the respective hermetically sealed tube and/or the cylindrical retaining bodies are formed of a material that contains a metal or a metallic compound for increasing the dielectric constant. In this way, even with a great distance between the electrodes of the lamp and a high gas filling pressure, the operating properties of the lamp can be improved and it can be reliably operated at a low breakdown voltage.

8 Claims, 8 Drawing Sheets

Fig. 5

| | 2 kW | | 3.5 kW | | 5 kW | | 8 kW | | 10 kW | |
|---|---|---|---|---|---|---|---|---|---|---|
| | conventional lamp | invention | conventional lamp | invention | conventional lamp | invention | conventional lamp | invention | conventional lamp | invention |
| relative dielectric constant of the glass $\varepsilon_1$ | 3.6 | 5.0 | 3.6 | 5.0 | 3.6 | 5.0 | 3.6 | 5.0 | 3.6 | 5.0 |
| break-through voltage (kV) | 15.0 | 13.5 | 19.0 | 16.0 | 24.0 | 17.5 | 29.0 | 19.5 | 30.0 | 20.0 |

Fig. 6(a)
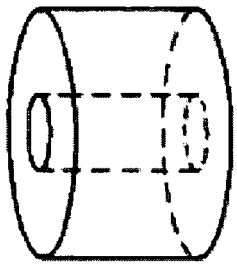
Fig. 6(b)
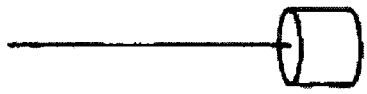
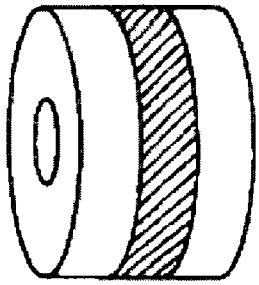
Fig. 6(c)
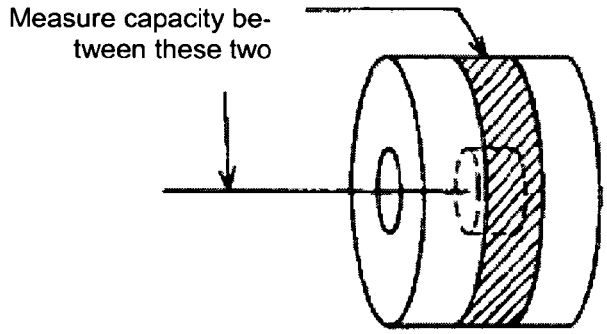
Fig. 6(d)

DISCHARGE LAMP OF THE SHORT ARC TYPE

BACKGROUND OF THE INVENTION

1. Field of the Invention

The invention relates to discharge lamp of the short arc type. The invention especially relates to discharge lamp of the short arc type which is used as the light source for a projection apparatus, and a discharge lamp of the short arc type which is used as the light source for semiconductor exposure and which is filled with mercury.

2. Description of Related Art

In a discharge lamp of the short arc type which is used for the above described purpose, conventionally, in the arc tube, there are large electrodes in order to suppress a temperature increase of the electrodes and to prevent thermal wearing of the electrodes. Furthermore, in the hermetically sealed tubes which border the arc tube, electrode rods which support the electrodes are each inserted into a glass cylindrical retaining body which is used to reduce the amount of contraction of the respective hermetically sealed tube, and is welded to the inside of the hermetically sealed tube in order to thus prevent damage to the hermetically sealed tube.

In this lamp, to improve the illumination property, one end of a trigger wire is wound onto one of the hermetically sealed tubes. The other end of this trigger wire is located along the outside surface of the arc tube on the other hermetically sealed tube.

There are cases in which the trigger wire is electrically connected to one of the electrodes. On the other hand, there are cases in which the trigger wire is not connected to any of the electrodes. In both cases, when a breakdown voltage is applied by an ignitor between the electrodes, it is possible to contribute to operation of the lamp.

A conventional technology in which the type of arrangement of these trigger wires is improved, a reduction of the breakdown voltage is attempted and thus a discharge lamp of the short arc type is reliably operated regardless of the type of operating device, is disclosed in Japanese patent disclosure document HEI 2-199766 (Patent document 1) and Japanese patent disclosure document HEI 2-210750 (Patent document 2)

In the field of semiconductor exposure, there has recently been a demand for a lamp with a still greater radiance of UV radiation for purposes of achieving an increase of the throughput in the exposure process. Furthermore, in the field of image display, there is a demand for a still larger lamp in order to increase the illumination of the screen. Here, there is a tendency for the lamp input power to become greater.

Therefore, in this lamp, the distance between the electrodes becomes large and the gas filling pressure is also high. The reason for increasing the distance between the electrodes is the following:

In the case of a small distance between the electrodes, the phenomenon occurs that the electrode tips begin to melt due to heat. To prevent this, it is necessary to increase the distance between the electrodes.

The reason for increasing the gas filling pressure in a lamp for semiconductor exposure is to increase the radiance of the UV radiation. For this purpose, a means for increasing the pressure of a buffer gas, such as argon, krypton, xenon or the like, is used. In a lamp for image display, a means for increasing the amount of xenon gas to be added is used to increase the light intensity, by which the gas filling pressure becomes high.

In these lamps, the electrodes acquire a large shape (especially with respect to the outside diameter of the body of the respective electrode), and the inside diameter of the hermetically sealed tube becomes large. Therefore, there is the tendency for the thickness of the cylindrical retaining body to increase in order to prevent the amount of contraction of the hermetically sealed tube from increasing.

However, if the lamp arrangement is changed in the above described manner, the lamp cannot be operated without increasing the breakdown voltage. But, if the breakdown voltage is increased, the amount of the surge which returns to the power source, i.e., the so-called noise, is increased. In this way, the disadvantage arises that the power source is destroyed or that the arrangement of the circuit for preventing destruction of the power source becomes complicated. This means that the disadvantage arises that the operating properties of the lamp are degraded.

SUMMARY OF THE INVENTION

A primary object of the present invention is to devise a discharge lamp of the short arc type which, even for a great distance between the electrodes and a high gas filling pressure, as was described above, can be reliably operated at a low breakdown voltage, and in which the operating properties of the lamp are improved.

The above described object is achieved in accordance with the invention by a discharge lamp of the short arc type which comprises:

an arc tube, hermetically sealed tubes which border this arc tube, and a pair of electrodes which are located in the arc tube, electrode rods which support the electrodes, support parts, each of which comprise part of one of the hermetically sealed tubes and in which a respective one of the electrode rods is securely held, and a trigger component which is located on the outside surface of the support parts, having the support parts of the respective hermetically sealed tube made of a material that contains a metal or a metallic compound for increasing the dielectric constant.

The above described object is also achieved in accordance with the invention by a discharge lamp of the short arc type which comprises:

an arc tube, hermetically sealed tubes which border this arc tube, and a pair of electrodes which are located in the arc tube, electrode rods which support the electrodes, support parts which each consist of part of one of the hermetically sealed tubes, cylindrical retaining bodies which are located in one of the support parts at a time and are welded to its inside and in which one of the electrode rods at a time is held securely, and a trigger component which is located on the outside surface of the support parts, having the support parts of the respective hermetically sealed tube and/or the cylindrical retaining bodies formed of a material that contains a metal or a metallic compound for increasing the dielectric constant.

Preferably, the above described metallic compound is a titanium compound.

The invention is further described below using several embodiments which are shown in the drawings.

BRIEF DESCRIPTION OF THE DRAWINGS

FIG. 5 is a table showing comparison results of the relative dielectric constants and the breakdown voltages in the hermetically sealed tube and in the cylindrical retaining body in conventional discharge lamps of the short arc type in which both the hermetically sealed tubes and also the cylindrical retaining bodies are made of silica glass, and in the discharge lamps of the short arc type of the invention titanium oxide has been mixed into the hermetically sealed tubes and the cylindrical retaining bodies, the lamps each having different input powers;

FIGS. 6(*a*) to 6(*d*) are schematic representations of the steps of a method for producing a measurement specimen for measuring the relative dielectric constant;

DETAILED DESCRIPTION OF THE INVENTION

Figure 1:
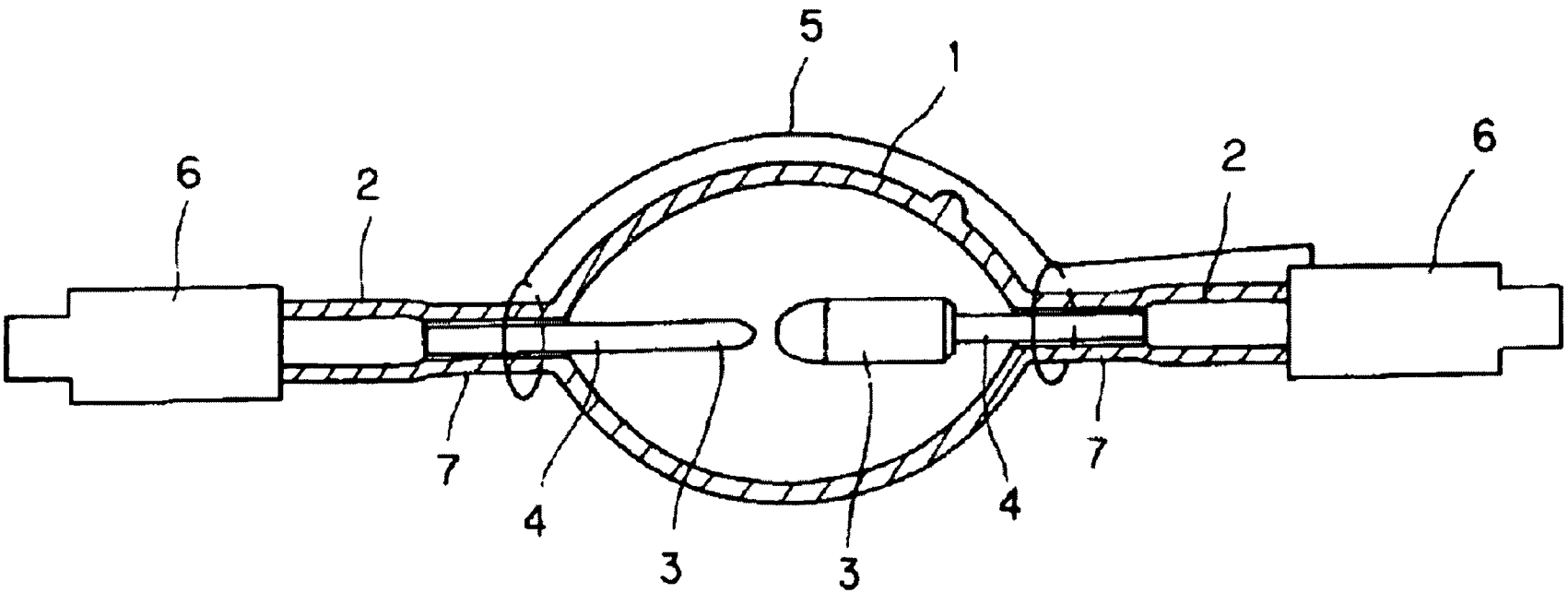
FIG. 1 is a longitudinal cross-sectional view of one embodiment of the arrangement of a discharge lamp of the short arc type in accordance with the invention.

FIG. 1 is a cross section of one embodiment of the arrangement of a discharge lamp of the short arc type. The arc tube 1 has hermetically sealed tubes 2 at each of opposite ends thereof. A pair of electrodes 3 are located in the arc tube 1 and are supported by electrode rods 4. A trigger component 5 such as a trigger wire or the like is provided on the outer surfaces of the hermetically sealed tubes 2. Moreover, the discharge lamp has bases 6 and support parts 7. The support parts 7 are each formed by a part of one of the hermetically sealed tubes 2 that has been contracted in this area (reduced in diameter). The electrode rod 4 is secured by the inside of the respective contracted hermetically sealed tube 2. A metal or a metallic compound is mixed in the support part 7 of this hermetically sealed tube 2 to increase the dielectric constant of this area.

The arc tube 1 and the hermetically sealed tubes 2 are made of silica glass and are formed in one piece with one another. In FIG. 1, the electrode 3 on the left side constitutes the cathode, the tip area on the electrode rod 4 acting as the cathode. As is shown in FIG. 1, the electrode rod 4 is secured by the inside of the support part of the contracted hermetically sealed tube 2. In this embodiment, an arrangement of the trigger component is undertaken in which one end of the trigger component 5 is connected to one of the bases 6 and in which part of the hermetically sealed tube 2 is wound with the other end of the trigger component 5.

Figure 2:
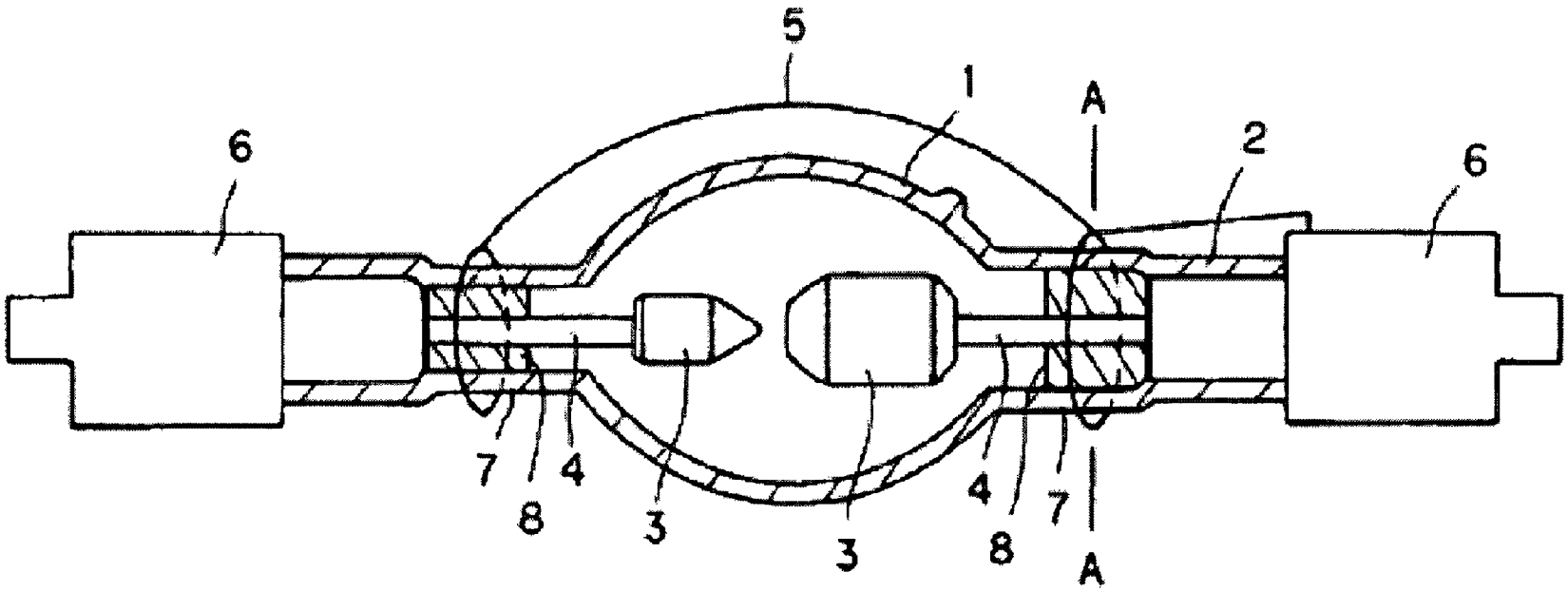
FIG. 2 is a longitudinal cross-sectional view of another embodiment of the arrangement of a discharge lamp of the short arc type in accordance with the invention.

FIG. 2 shows a cross section of an embodiment of the discharge lamp of the short arc type which differs from FIG. 1. In FIG. 2, a cylindrical retaining body 8, which made of a glass cylinder, is welded to the inside of the support part 7 of the hermetically sealed tube 2 and secures the electrode rod 4 inserted into it. In the discharge lamp of the short arc type of this embodiment, a metal or a metallic compound for increasing the dielectric constant of the support part 7 and of the cylindrical retaining body 8 of the hermetically sealed tube 2 is mixed into the support part 7 and the cylindrical retaining body 8 of the hermetically sealed tube 2, or a metal or a metallic compound for increasing the dielectric constant of the support part 7 or of the cylindrical retaining body 8 of the hermetically sealed tube 2 is mixed into the support part 7 or the cylindrical retaining body 8 of the hermetically sealed tube 2. The components otherwise correspond to the components shown in FIG. 1 with the same reference numbers and are therefore not further described.

As is shown in FIG. 2, the discharge lamp of the short arc type in this embodiment differs from the discharge lamp of the short arc type shown in FIG. 1 in that the electrode rod 4 is securely held by the cylindrical retaining body 8 which is located on the inside of the support part 7 of the hermetically sealed tube 2, while in the discharge lamp of the short arc type shown in FIG. 1 the electrode rod 4 is secured by the inside of the support part 7 of the hermetically sealed tube 2.

Using FIGS. 3 & 4, the reason is described below why the breakdown voltage of the discharge lamp of the short arc type can be reduced using the example of the discharge lamp of the short arc type shown in FIG. 2, in which a metal or a metallic compound has been mixed into the support part 7 and the cylindrical retaining body 8 of the hermetically sealed tube 2.

Figure 3:
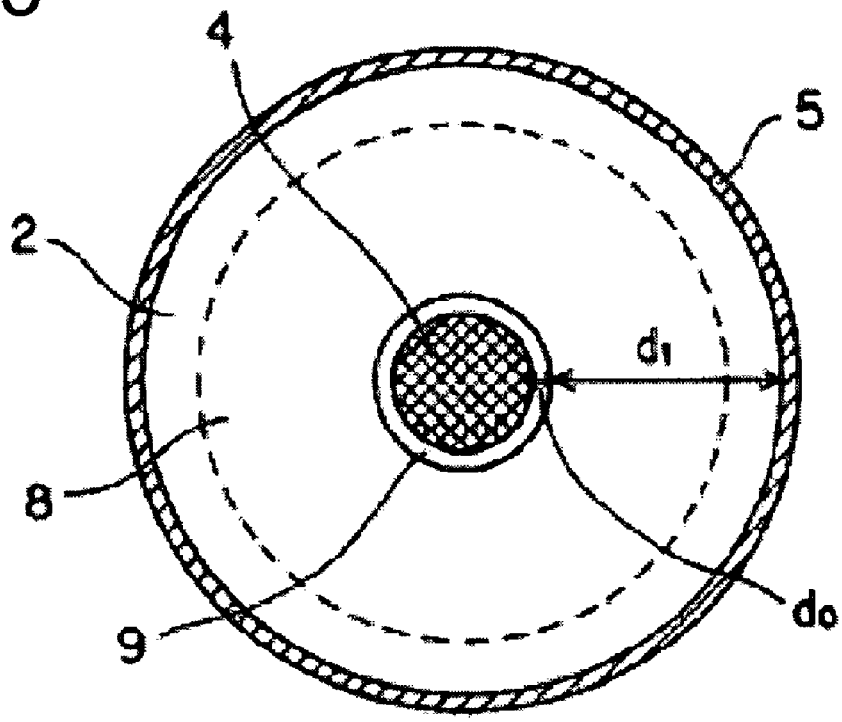
FIG. 3 is an enlarged transverse cross-sectional representation taken along line A-A in FIG. 2.

FIG. 3 is an enlarged sectional view taken along line A-A of FIG. 2. In the figure, a gap 9 of width $d_0$ is shown between the cylindrical retaining body 8 and the electrode rod 4, the distance between the trigger component 5 and the gap 9 at which the thickness of the hermetically sealed tube 2 and the thickness of the cylindrical retaining body 8 are added is $d_1$. The other reference numbers correspond to the like numbered components shown in FIG. 2.

As is shown in FIG. 3, in the support part 7 of the hermetically sealed tube 2, a capacitor is formed with the electrode rod 4 and the trigger component 5 forming the two electrodes and by the support part 7 of the hermetically sealed tube 2, the cylindrical retaining body 8 and the gap 9 being between them.

Figure 4:
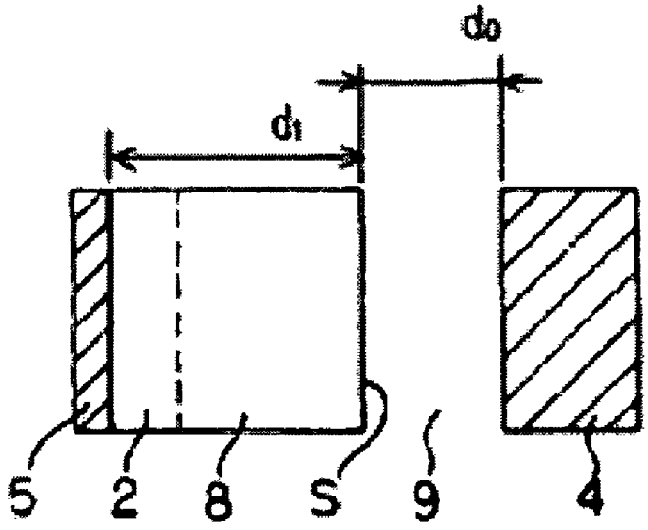
FIG. 4 is a schematic representation of the cross section shown in FIG. 3 as an equivalent capacitor.

FIG. 4 is a schematic which shows the cross section shown in FIG. 3 as an equivalent capacitor. Here, the following applies when the electrostatic capacitance of the silica glass of the support part 7 of the hermetically sealed tube 2 and of the cylindrical retaining body 8 is $C_1$, the dielectric constant of the silica glass of the support part 7 of the hermetically sealed tube 2 and of the cylindrical retaining body 8 is $\in_1$, the electrostatic capacitance of the gap 9 is $C_0$, the dielectric constant at the gap 9 is $\in_0$, the electrode area is S, the potential difference which is applied between the electrode rod 4 and the trigger component 5 is V, the potential difference in the gap 9 is $V_o$ and the field strength in the gap 9 is $E_o$ $$C_1=\in_1 \cdot S/d_1,\ C_0=\in_0 \cdot S/d_0.$$

Moreover the following applies:

$$\begin{aligned} E_o &= V_0/d_0 = (V/d_0)\cdot(1/C_0)/(1/C_0+1/C_1) \\ &= (V/d_0)\cdot(d_0/\varepsilon_0\cdot S)/(d_0/\varepsilon_0\cdot S+(d_1/\varepsilon_1\cdot S) \\ &= V/(d_0+d_1\cdot\varepsilon_0/\varepsilon_1) \end{aligned}$$

Here, an improvement of the operating properties of the lamp is identical to facilitating the induction of an insulation breakdown at the gap 9. This means that, by increasing the field intensity $E_0$ at the gap 9 for the above described formula, an insulation breakdown at the gap 9 can be more easily induced.

To increase the field strength $E_0$ for the above described formula, the procedure is as follows:

Either the distance $d_0$ of the gap 9 between the electrode rod 4 and the inside of the cylindrical retaining body 8 is reduced, or the distance $d_1$, as the sum of the thickness of the hermetically sealed tube 2 and the thickness of the cylindrical retaining body 8, is reduced, or the dielectric constant $\in_1$ for the silica glass of the hermetically sealed tube 2 and of the cylindrical retaining body 8 is increased.

In this case, a reduction of the distance $d_0$ means a reduction of the distance between the electrode rod 4 and the inside of the cylindrical retaining body 8. However, with respect to production, this distance cannot be made smaller than or equal to a certain distance. Furthermore, a reduction of the distance $d_1$ means a reduction of the entire thickness as the sum of the thickness of the hermetically sealed tube 2 and the thickness of the cylindrical retaining body 8. If this thickness is reduced there is, however, the disadvantage that the strength of the hermetically sealed tube 2 is reduced.

Therefore, it becomes apparent that an increase of the dielectric constant $\in_1$ for the silica glass of the hermetically sealed tube 2 and of the cylindrical retaining body 8 is one advantageous measure.

For this reason, in the discharge lamp of the short arc type shown in FIG. 1, a metal or metallic compound is mixed at least into the support part 7 (the material from which the support part is made) of the hermetically sealed tube 2 for increasing the dielectric constant in the support part 7 of the hermetically sealed tube 2. Furthermore, in the discharge lamp of the short arc type shown in FIG. 2, a metal or a metallic compound is mixed at least into the support part 7 or into the cylindrical retaining body 8 of the hermetically sealed tube 2 in order to increase the dielectric constant for the support part 7 and/or the cylindrical retaining body 8 of the hermetically sealed tube 2. Specifically, as the metallic compound which is to be mixed in, titanium oxide ($TiO_2$) was used as the metallic compound.

FIG. 5 is a table of the comparison results of the relative dielectric constant and of the breakdown voltage in the hermetically sealed tube and in the cylindrical retaining body for conventional discharge lamps of the short arc type in which both the hermetically sealed tubes and also the cylindrical retaining bodies are made of silica glass, and in the discharge lamps of the short arc type of the invention in which titanium oxide has been mixed into the hermetically sealed tubes and the cylindrical retaining bodies, the lamps each having different input powers.

As is apparent from FIG. 5, all the discharge lamps of the short arc type in accordance with the invention have greater dielectric constants for the hermetically sealed tubes and the cylindrical retaining bodies than the conventional discharge lamps of the short arc type. For all lamps with different input powers, the respective discharge lamp of the short arc type has a lower breakdown voltage than the respective conventional discharge lamp of the short arc type.

This means that, for the respective discharge lamp of the short arc type of the invention, even at a low breakdown voltage, the lamp can be reliably operated, and thus, the operating properties of the lamp can be improved.

Furthermore, it becomes apparent from FIG. 5 that an improvement of the operating properties of the lamp in a discharge lamp of the short arc type clearly appears at greater than or equal to 5 kW.

The process for measuring the relative dielectric constant shown in FIG. 5 is described below.

First, using FIGS. 6(*a*) to 6(*d*), the method of producing a measurement specimen for measuring the relative dielectric constant is described.

As is shown in FIG. 6(*a*), in a conventional discharge lamp of the short arc type and in a discharge lamp of the short arc type of the invention, a plug (hereinafter called glass) is cut out which corresponds to the support part 7 and the cylindrical retaining body 8 of the hermetically sealed tube 2 of the discharge lamp of the short arc type shown in FIG. 2. Next, metallic films and the like which were applied to the electrode rod in the excised glass and to the outside surface of the glass are removed, by which a state of only the glass is obtained.

Next, as shown in FIG. 6(*b*), a metal rod is prepared with a diameter which is equal to the inside diameter of the glass and with a length which is less than or equal to ½ of the glass length. On this metal rod, a metal wire is welded which acts as a terminal in the measurement and which is extremely thin compared to the metal rod.

Next, as is shown in FIG. 6(*c*), a metallic film with the same width as the above described metal rod is applied to the outside periphery of the metal area of the glass which has been produced according to FIG. 6(*a*).

Then, as is shown in FIG. 6(*d*), the metal rod produced according to FIG. 6(*b*) is inserted into the glass which has been produced according to FIG. 6(*c*). Here, the position of the metal rod and the position of the metallic film in the outside periphery of the middle area of the glass are brought into agreement. In this way, a measurement specimen is prepared.

Next, to measure the electrostatic capacitance of the above described measurement specimen, between the metallic film which has been applied to the outside glass periphery, and the metal wire which is connected to the metal rod, a measurement was taken with a LCZ measuring instrument. The electrostatic capacitance was measured under the condition of a frequency of 1 kHz. The LCZ measuring device used was a LCZ METER 2340 which was built by NF Electronic Instruments.

The computation of the relative dielectric constant of the glass which constitutes the above described measurement specimen based on the measured electrostatic capacitance is described below.

Since the glass which constitutes the above described measurement specimen can be regarded as a concentric cylinder, the electrostatic capacitance of the concentric cylinder per unit of length can be expressed as follows, if the distance between the middle of this concentric cylinder and the inside of the cylinder is a, the distance between the middle of the concentric cylinder and the outside of the cylinder is b and the dielectric constant of this glass is $\in_q$:

$$C=2\pi\in_q/\log_{10}b/a(F)$$

The dielectric constant $\in_q$ (F/m) is computed therefrom. From $\in_q=\in_1\times\in_0$ using the dielectric constant in a vacuum $\in_0=8.85\times10^{-12}$ (F/m) $\in_0$ the relative dielectric constant of the glass $\in_1$ can be computed.

Using FIGS. 7 to 9, each process for arranging the trigger component is described below, and they differ from the process for arranging the trigger component of the discharge lamp of the short arc type shown in FIG. 2.

Figure 7:
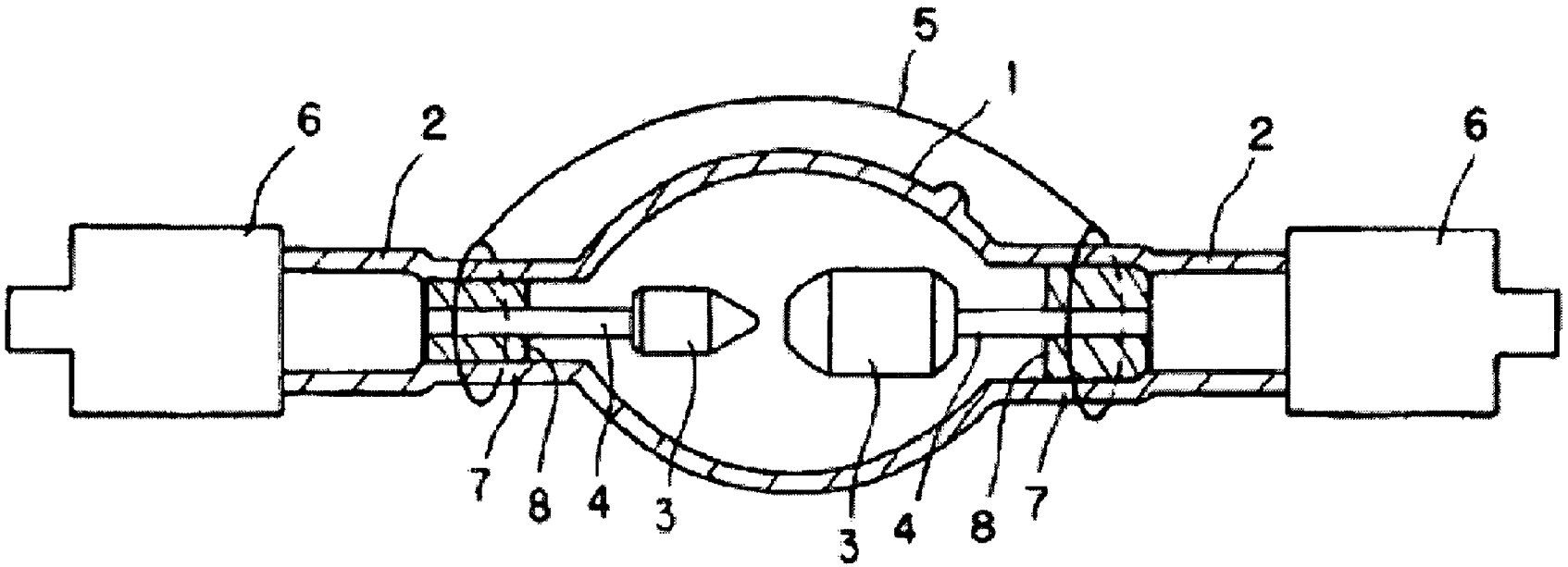
FIG. 7 is a longitudinal cross-sectional view of a trigger component arrangement which differs from the arrangement of the trigger component of the discharge lamp of the short arc type shown in FIG. 2.

In the discharge lamp of the short arc type shown in FIG. 7, the trigger component 5 is not connected to any of the bases 6, but it is simply placed between the hermetically sealed tubes 2 and the two ends are wound around the support parts 7 of the hermetically sealed tubes 2. In this case, the trigger component 5 is not connected electrically to the electrodes 3, but is floating. In this lamp, the breakdown voltage between the electrodes is not very high, but an insulation breakdown is induced by the high voltage from the igniter. Furthermore, there is a trigger component 5 for improving the operating properties.

Figure 8:
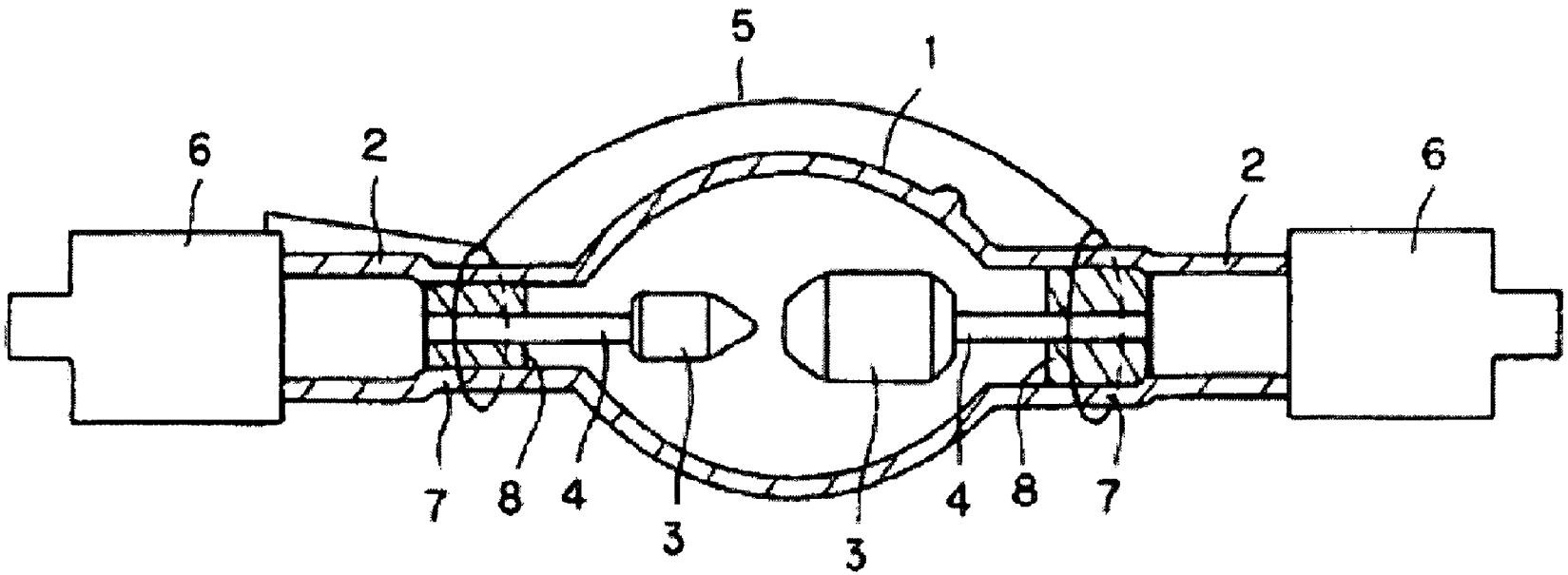
FIG. 8 is a longitudinal cross-sectional view of another trigger component arrangement which differs from the arrangement of the trigger component of the discharge lamp of the short arc type shown in FIG. 2.

In the discharge lamp of the short arc type shown in FIG. 8, differing from the discharge lamp of the short arc type shown in FIG. 2, one end of the trigger component 5 is connected to the base 6 which is connected to the electrode 3, the cathode, which is shown on the left side in the drawings. This arrangement is undertaken when, in conjunction with the power source, the electrode 3 which constitutes the cathode has a negative high voltage. In FIG. 2, the electrode 3 which represents the anode has a positive high voltage and the trigger component 5 is connected to the base 6 which is connected to the electrode 3 which represents the anode.

Figure 9:
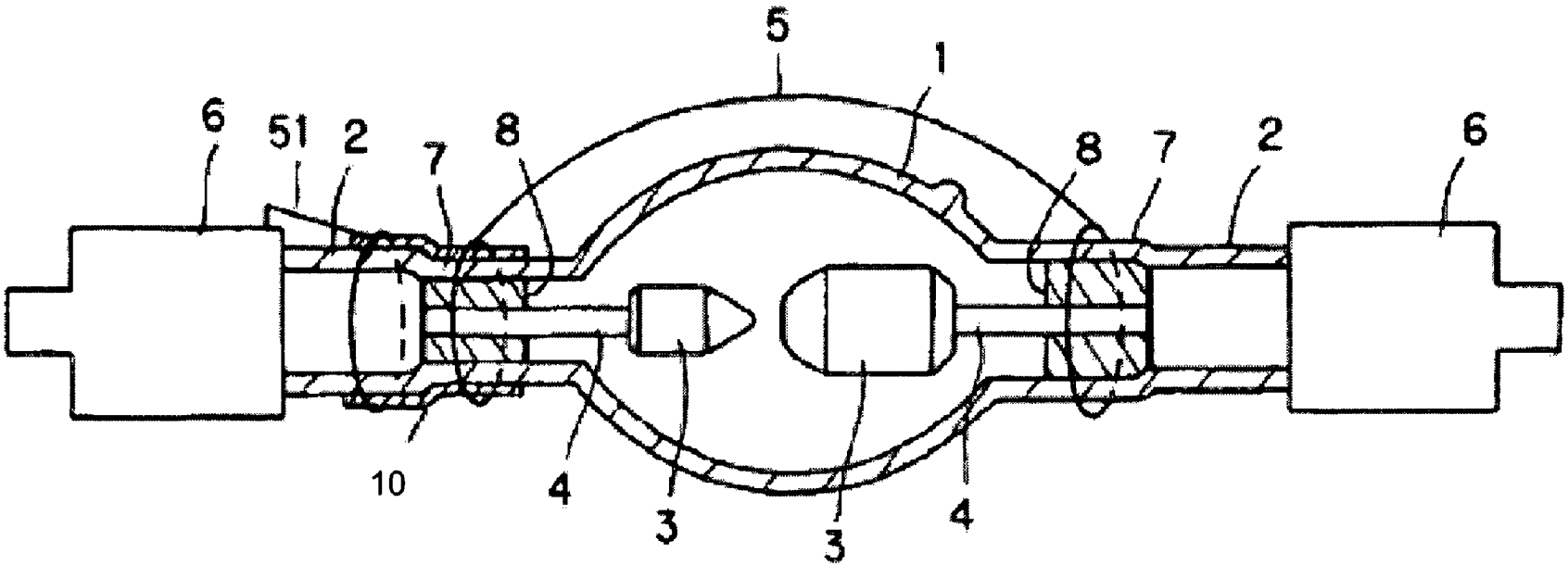
FIG. 9 is a longitudinal cross-sectional view of yet another trigger component arrangement which differs from the arrangement of the trigger component of the discharge lamp of the short arc type shown in FIG. 2.

In the discharge lamp of the short arc type shown in FIG. 9, on the surface of the hermetically sealed tube 2 on the left side in the drawing, a conductive metallic film 10 is formed. One end of the trigger component 51, which is different from the trigger component 5, is connected to the base 6 on the left side of the drawing. The other end of the trigger component 51 is wound around the surface of the supporting part 7. The trigger component 5 is placed between the hermetically sealed tubes 2 and the two ends are wound around the support parts 7 of the hermetically sealed tubes 2. The trigger component 5 and the trigger component 51 are electrically connected to one another via the metallic film 10.

Action of the Invention

In a first aspect of the invention a discharge lamp of the short arc type comprises:

an arc tube, hermetically sealed tubes which border this arc tube, and a pair of electrodes which are located in the arc tube, electrode rods which support the electrodes, support parts which each consist of part of one of the hermetically sealed tubes and in which one of the electrode rods at a time is held securely, a trigger component which is located on the outside surface of the support parts, and the material comprising the support parts of the respective hermetically sealed tube contains a metal or a metallic compound for increasing the dielectric constant.

Therefore, even in a discharge lamp of the short arc type with a large distance between the electrodes of the lamp and also with a high gas filling pressure the field strength of the gap which is formed between the electrode rod and the inside of the support part of the hermetically sealed tube can be increased. Thus, the lamp can also be reliably operated at a low breakdown voltage.

In a second aspect of the invention, a discharge lamp of the short arc type comprises:

an arc tube, hermetically sealed tubes which border this arc tube, and a pair of electrodes which are located in the arc tube, electrode rods which support the electrodes, support parts which each consist of part of one of the hermetically sealed tubes cylindrical retaining bodies which are located in one of the support parts at a time and are welded to its inside and in which one of the electrode rods at a time is held securely, a trigger component which is located on the outside surface of the support parts, and the material comprising the support parts of the respective hermetically sealed tube and/or the cylindrical retaining bodies contains a metal or a metallic compound for increasing the dielectric constant.

Therefore, even in a discharge lamp of the short arc type with a large distance between the electrodes of the lamp and also with a high gas filling pressure, the field strength of the gap can be increased which is formed between the electrode rod and the inside of the cylindrical retaining body. Thus, the lamp can also be reliably operated at a low breakdown voltage.

In one development of the two aspects of the invention, a titanium compound is used as the metallic compound. Therefore, the dielectric constant of the support part and/or of the cylindrical retaining body of the hermetically sealed tube can be easily increased.

What is claimed is:

1. Discharge lamp of the short arc type which comprises:

an arc tube, hermetically sealed tubes, each of which is located at a respective one of opposite ends of the arc tube, a pair of electrodes which are located in the arc tube, electrode rods which support the electrodes, support parts, each of which is formed by part of one of the hermetically sealed tubes, cylindrical retaining bodies, each of which is located completely within in intimate contact with a respective one of the support parts along the full length thereof and in which a respective one of the electrode rods is held securely, and wherein the cylindrical retaining bodies are formed from a material having silica glass as the main component and containing a metal or a metallic compound in a manner which functions as a means for increasing the dielectric constant to decrease the breakdown voltage, and a trigger component which is located on an outer side surface of the support parts, wherein the trigger component includes a trigger wire wound around the support parts, wherein a gap is located between the cylindrical retaining bodies and the electrode rod forming a capacitor with the retaining bodies and electrode at least in an area in which the trigger wire is wound.

2. Discharge lamp of the short arc type as claimed in claim 1, wherein the metal or metallic compound is a titanium compound.

3. Discharge lamp of the short arc type as claimed in claim 2, wherein the arc tube is formed from a material having silica glass as the main component.

4. Discharge lamp of the short arc type as claimed in claim 1, wherein the trigger wire is connected to one of the electrodes.

5. Discharge lamp of the short arc type as claimed in claim 1, wherein the hermetically sealed tubes are provided with lamp bases, and wherein the trigger wire is connected to one of the lamp bases.

6. Discharge lamp of the short arc type as claimed in claim 5, wherein a conductive metallic film is formed on a surface of one of the support parts, and wherein another trigger component is connected at one end to one of the lamp bases and another end is wound around the support part on which the metal film is formed.

7. Discharge lamp of the short arc type as claimed in claim 1, wherein the electrode rod and the trigger component form the electrodes of the capacitor with the support part of the hermetically sealed tube.

8. Discharge lamp of the short arc type as claimed in claim 1, wherein the metal or a metallic compound in a manner which functions as a means for increasing the dielectric constant is titanium.

* * * * *